United States Patent [19]

Van House

[11] 4,169,456

[45] Oct. 2, 1979

[54] SHORT LIMB ARCHERY BOW

[76] Inventor: Robert M. Van House, 268 Enfield Rd., Dayton, Ohio 45459

[21] Appl. No.: 822,682

[22] Filed: Aug. 8, 1977

Related U.S. Application Data

[63] Continuation-in-part of Ser. No. 598,569, Jul. 24, 1975, Pat. No. 4,041,927.

[51] Int. Cl.[2] ..... F41B 5/00

[52] U.S. Cl. ..... 124/61; 124/25

[58] Field of Search ..... 124/16, 20 B, 21, 22, 124/23 R, 23 A, 24 R, 24 A, 25, 26, 61, 86, 88; 272/130; 267/65 R, 124

[56] References Cited

U.S. PATENT DOCUMENTS

| | | | |
|---|---|---|---|
| 1,815,200 | 7/1931 | Hamburger | 124/23 R UX |
| 2,714,377 | 8/1955 | Mulkey | 124/24 R |
| 3,028,851 | 4/1962 | Drake | 124/16 |
| 3,260,515 | 7/1966 | Albers | 267/124 |
| 3,561,419 | 2/1971 | Cucuzza, Sr. | 124/25 |
| 3,744,473 | 7/1973 | Nishioka | 124/24 R |
| 3,809,048 | 5/1974 | Handford | 124/25 |
| 3,874,359 | 4/1975 | Cesin | 124/16 |
| 3,987,777 | 10/1976 | Darlington | 124/23 R |
| 3,989,026 | 11/1976 | Nishioka | 124/24 R |
| 4,064,977 | 12/1977 | Taylor | 267/65 R |

FOREIGN PATENT DOCUMENTS

| | | | |
|---|---|---|---|
| 2459310 | 6/1976 | Fed. Rep. of Germany | 124/25 |
| 980014 | 12/1950 | France | 124/25 |

*Primary Examiner*—Richard T. Stouffer
*Attorney, Agent, or Firm*—Jacox & Meckstroth

[57] ABSTRACT

An archery bow provided with a pair of limbs which are relatively short in length in consideration of the length of draw provided. Pulleys are attached to the limbs and a block and tackle type of arrangement is employed to multiply the ratio of bow string draw force to bow limb tip force. A single motor member is employed to move the bow limbs for launching an arrow. Connector members are provided between the motor member and the bow limbs for synchronous movement of the bow limbs.

6 Claims, 8 Drawing Figures

SHORT LIMB ARCHERY BOW

RELATED PATENT APPLICATION

This application is a continuation-in-part of Ser. No. 598,569, entitled: Archery Bow With Pivoted Bow Limbs Having Rotational Synchronizer and Adjustable Draw Force Mechanism, filed July 24, 1975, now U.S. Pat. No. 4,041,927, issued Aug. 16, 1977.

BACKGROUND OF THE INVENTION

The conventional archery bow comprises an elongate member which can be bent into an arc and which has resiliency therein which urges the elongate member to return toward a straight condition. The conventional bow includes a bow string joined to the ends of the elongate member. As the bow string of a conventional bow is drawn, the ratio of the drawn distance to the draw force is nearly linear until a point is reached at which the draw force rises much more rapidly than the draw distance. The point at which this rapid increase in force occurs is related to the length of the elongate member which forms the bow, in that the point is reached after only a short draw of the bow string in a short bow. Thus, it has been considered desirable to employ a relatively long bow so that significant values of energy can be established in the bow without requiring large forces.

However, short compact bows are particularly desirable and advantageous in minimizing space requirements and in permitting ease in carrying of the bow. A small compact archery bow is particularly advantageous in hunting, as the hunter moves through closely positioned trees, underbrush and the like.

It is therefore an object of this invention to provide an archery bow which is relatively small and compact and which is capable of applying significant force to an arrow in the launching thereof.

It is another object of this invention to provide such an archery bow which is capable of high energy storage.

Another object of this invention is to provide such an archery bow in which bow limbs are rotated through large angles without significant loss of effective conversion of bow string draw force to bow limb torque, thus permitting the use of bow limbs which are relatively short.

Another object of this invention is to provide such an archery bow within which the force required to maintain the bow string in full draw position is less than the peak draw force.

Another object of this invention is to provide such an archery bow which can be constructed as a cross-bow type or as a long bow type.

It is another object of this invention to provide such an archery bow in which a single drive motor may be employed.

Another object of this invention is to provide such an archery bow in which the stored energy available in a drive motor can be readily adjusted.

It is another object of this invention to provide such an archery bow in which the ratio of draw distance to draw force can be readily adjusted.

Another object of this invention is to provide such an archery bow in which movement of a plurality of limbs is automatically synchronized.

Another object of this invention is to provide such an archery bow in which the bow span at full draw position is significantly less than the bow span in the braced or relaxed bow condition.

Other objects and advantages of this invention reside in the construction of parts, the combination thereof, the method of production, and the mode of operation, as will become more apparent from the following description.

SUMMARY OF THE INVENTION

An archery bow of this invention comprises a support member, a pair of bow limbs movably attached to the support member and extending laterally therefrom at opposed positions, a drive motor, means joining the drive motor to the bow limbs, a bow string joined to the bow limbs, and means for simultaneous movement of the bow limbs for launching an arrow.

DESCRIPTION OF THE PREFERRED EMBODIMENT

Figure 1:
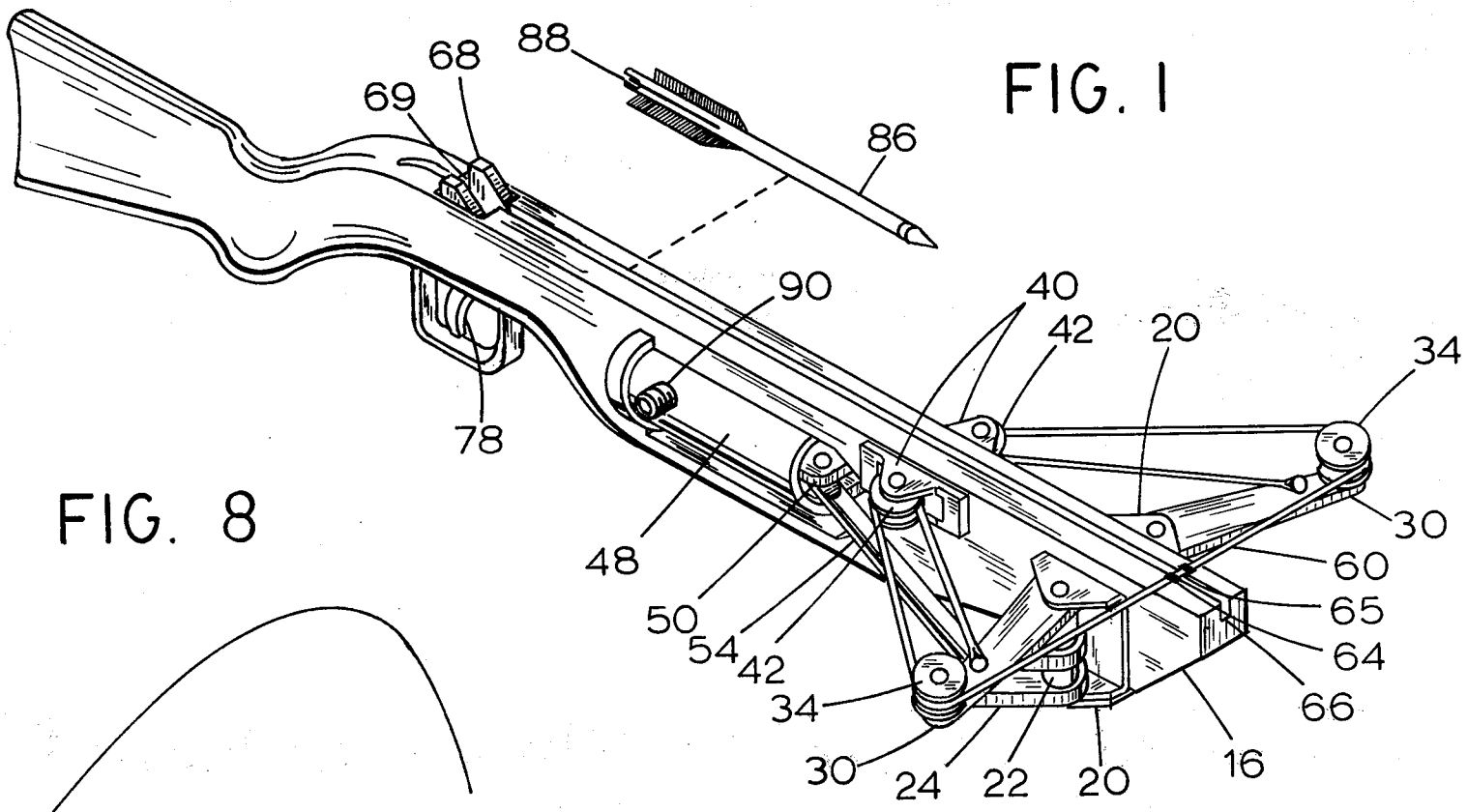
FIG. 1 is a perspective view of an archery bow of this invention, showing an arrow adapted to be launched by the archery bow.

The archery bow of this invention illustrated in the drawings is shown as comprising a crossbow type. However, it is to be understood that the structural principles involved in an archery bow of this invention may be included in archery bows other than crossbows.

The archery bow shown in FIGS. 1–7 comprises an elongate support member or stock 16. At the forward portion of the stock 16 and on opposed sides thereof are a pair of brackets 20, each of which pivotally supports a shaft 22, which is shown as being normal to the axis of the stock 16. Each shaft 22 has integral therewith a lever 24. Each shaft 22 also has integrally attached thereto a limb 30. Each limb 30 has rotatably attached thereto adjacent the end thereof a pulley 34.

Secured to the stock 16 and spaced rearwardly of the brackets 20 are brackets 40, there being one bracket 40 on each of the opposed sides of the stock 16. Rotatably supported by each bracket 40 is a pulley 42.

Figure 2:
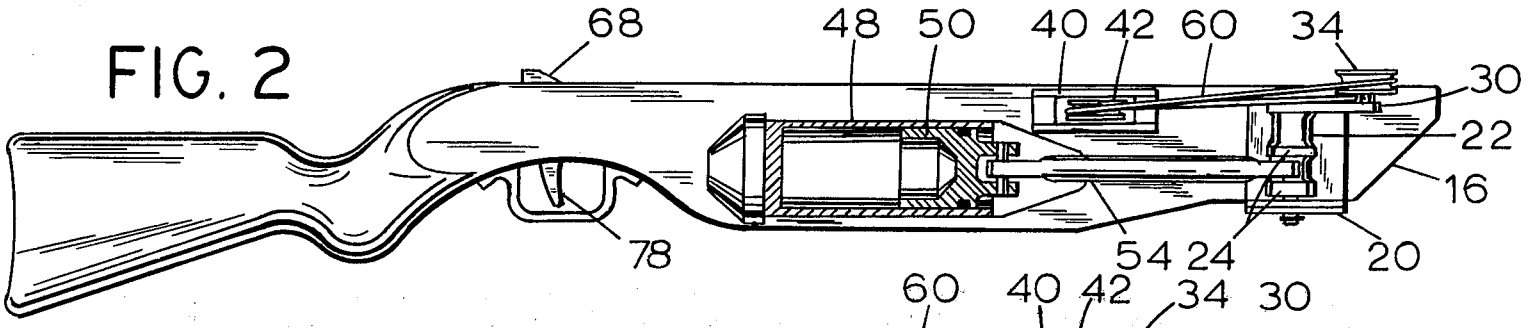
FIG. 2 is a side view of the bow of FIG. 1, showing parts broken away and in section.
Figure 5:
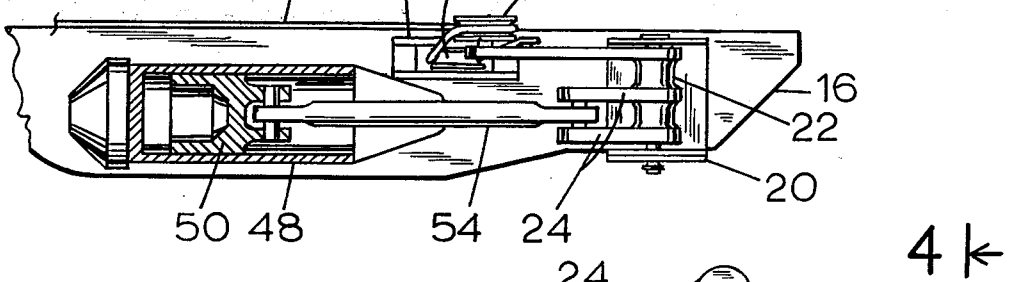
FIG. 5 is a fragmentary side view with parts broken away and shown in section, and showing elements of the archery bow in full draw position.

Positioned within the stock 16, rearwardly of the brackets 40 is a motor member 48. The motor member 48 is shown as being cylindrical. As shown in FIGS. 2 and 5, the motor 48 has an axially movable piston 50 therewithin. The volume and pressure of air or other gas within the motor 48 is controlled by the position of the piston 50. Thus, the motor 48 may be referred to as a gas or air operated motor. However, other types of motors are also satisfactory.

A pair of piston rods 54 are pivotally attached to the piston 50 and extend forwardly therefrom. Each piston rod 54 is also pivotally attached to one of the levers 24.

A bow string 60 has each of its ends attached to one of the limbs 30. The bow string 60 also partially encompasses and is in engagement with the pulleys 34 and 42. The bow string 60 also extends across the stock 16 and between the pulleys 34. A pair of spaced-apart markers 64 are attached to the bow string 60 between the pulleys 34 and establish a nock point 65 therebetween.

Figure 7:
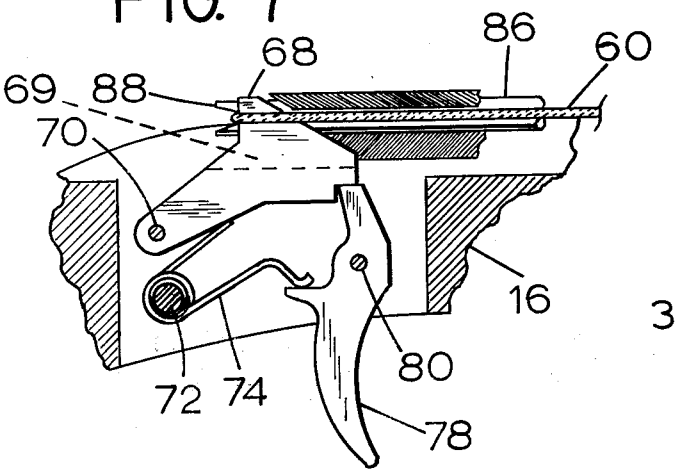
FIG. 7 is an enlarged fragmentary view showing a trigger mechanism of the archery bow of this invention.

The stock 16 has a channel 66 therein extending from the forward end thereof to a position adjacent a bow string latch 68, which has a groove 69 for arrow clearance. As illustrated in FIG. 7, the latch 68 is pivotally supported by a pin 70 within the stock 16. A stem 72 supports a spring 74, which engages the latch 68. The spring 74 also engages a trigger member 78 which is pivotally supported by a pin 80.

Figure 8:
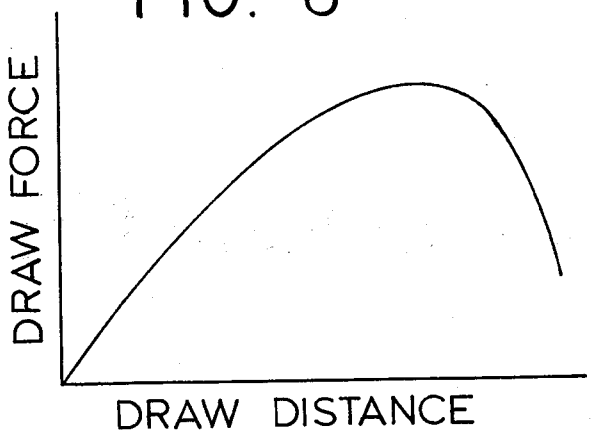
FIG. 8 is a graph illustrating string draw force versus string draw distance in an archery bow of this invention.
Figure 6:
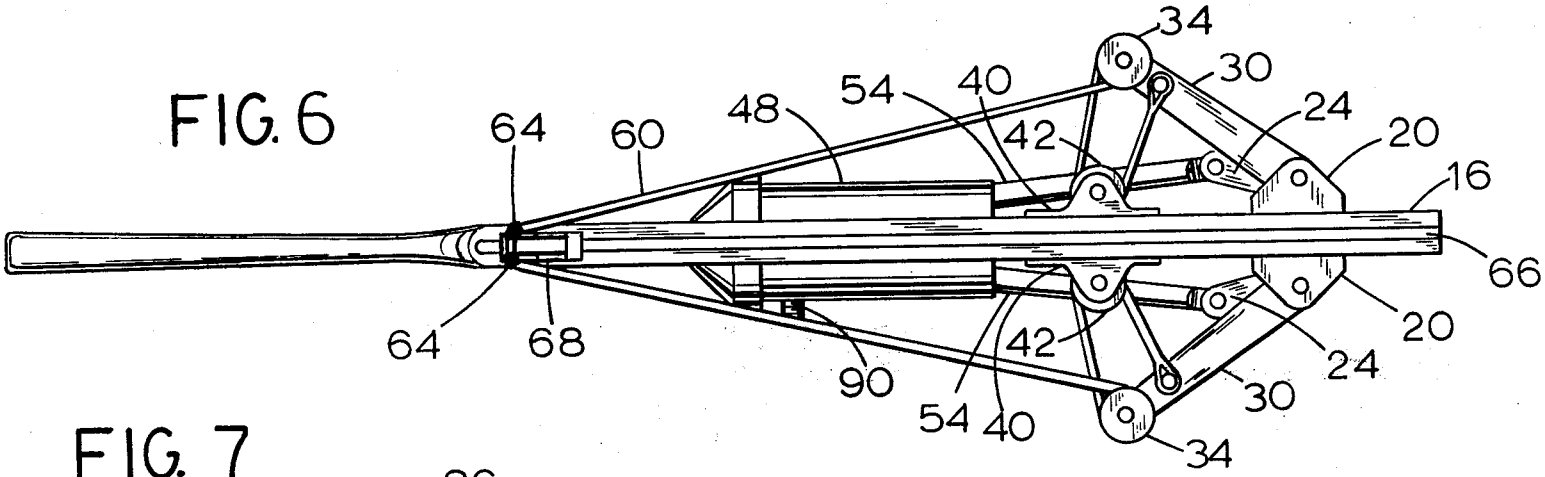
FIG. 6 is a top view of the archery bow of this invention showing the elements thereof in full draw position.
Figure 4:
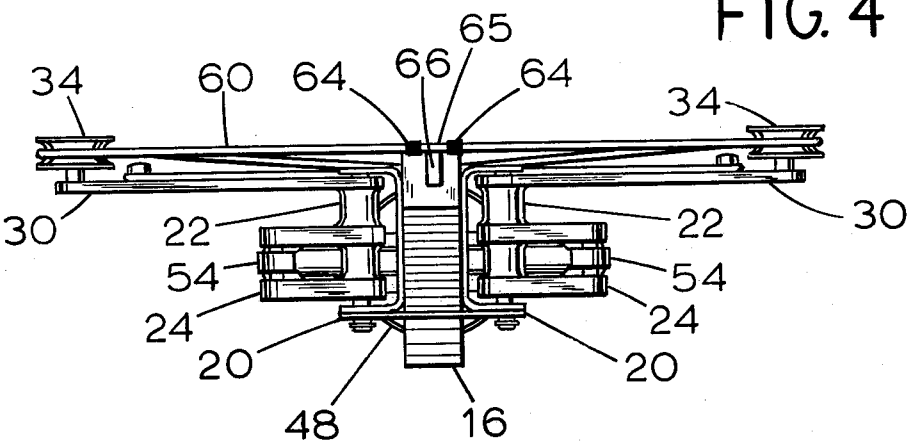
FIG. 4 is an enlarged front view taken substantially on line 4—4 of FIG. 3.

The channel 66 is adapted to receive an arrow, such as an arrow 86 shown in FIGS. 1 and 7. The arrow 86 has a notch 88 in the end thereof within which the nock point 65 of the bow string 60 is positioned. The bow string 60 is adapted to be drawn rearwardly on the stock 16 to position the nock point 65 within the groove 69 of the latch 68. When the nock point 65 of the bow string 60 is drawn rearwardly to be retained by the latch 68, the limbs 30 are pivotally moved rearwardly, as illustrated in FIGS. 5 and 6. FIG. 8 illustrates the change which occurs in the force necessary to draw the bow string 60 with respect to the distance of draw of the bow string 60. FIG. 8 also reveals that the force necessary to maintain the bow string 60 in a drawn position is less than the peak draw force necessary to reach the full draw position. These conditions occur as a result of the large angular movement of the limbs 30 and levers 24 as the nock point 65 of the bow string 60 is drawn rearwardly. The large angular movement of the limbs 30 occurs because the limbs 30 are relatively short in consideration of the total length of the bow string 60 and length of travel of nock point 65.

As the nock point 65 of the bow string 60 is drawn rearwardly and as the limbs 30 are pivotally moved, the levers 24 are also pivotally moved. Pivotal movement of the levers 24 causes the piston rods 54 to move and to force the piston 50 rearwardly within the motor 48. As the piston 50 moves rearwardly, air or other gas confined within the motor 48 is compressed. In the full draw position of the bow string 60 the piston 50 is positioned within the motor 48 substantially as shown in FIG. 5. In such position of the piston 50, the air or other gas confined within the motor 48 represents stored energy urging the piston 50 forwardly, while the bow string 60 remains in its drawn position.

When the trigger 78 is pivotally moved, the latch 68 is permitted to pivotally move and release the nock point 65 of the bow string 60. Thus, the air or other gas within the motor 48 is permitted to force the piston 50 forwardly at a high rate and the piston rods 54 are forced forwardly at a high rate. Thus, the levers 24 and the limbs 30 are forced to pivotally move at a high rate. Thus, the nock point 65 of the bow string 60 moves rapidly forwardly and the arrow 86 is launched at a high rate and with significant power.

Figure 3:
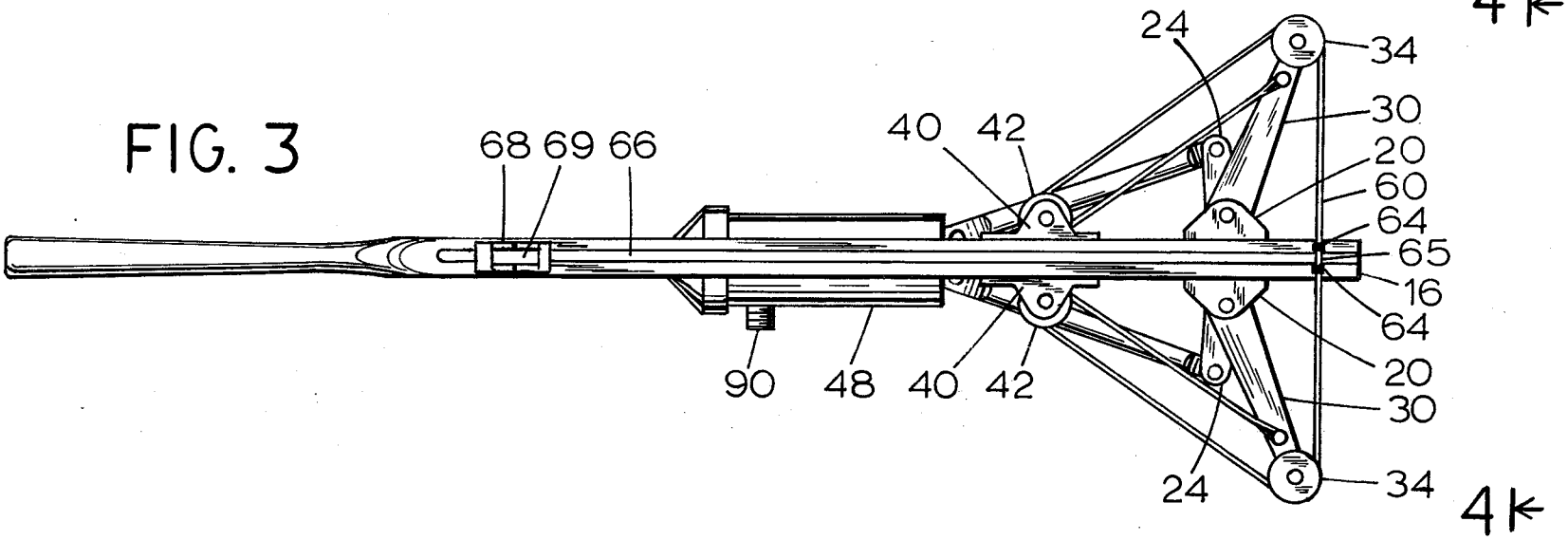
FIG. 3 is a top view of the archery bow of FIGS. 1 and 2.

FIGS. 1 and 3 show a valve 90 which is a part of the motor 48 through which gas flows into and out of the motor 48. The total charge or mass of air or other gas can be readily changed by forcing additional air or other gas into the motor 48 through the valve 90 or by permitting the air or other gas to flow from the motor 48 through the valve 90. Thus, the total energy available in the motor 48 to launch an arrow can be readily adjusted.

Although the preferred embodiment of the short limb archery bow of this invention has been described, it will be understood that within the purview of this invention various changes may be made in the form, details, proportion and arrangement of parts, the combination thereof, and the mode of operation, which generally stated consist in the short limb archery bow within the scope of the appended claims.

The invention having thus been described, the following is claimed:

1. An archery bow of the type having a stock provided with opposed side portions and having a latch member and a trigger member, the stock being provided with a portion adapted to support an arrow for launching thereof, the combination comprising:

a pair of limb members, there being one limb member pivotally supported at each of the side portions of the stock, a pair of lever members, there being one lever member secured to each limb member for pivotal movement therewith, a plurality of pulleys, there being a pulley rotatively supported by each limb member adjacent the end thereof, there being a pulley attached to the stock at each of the opposed side portions thereof, a bow string provided with a pair of end portions, each of the end portions being attached to one of the limb members, the bow string also being in engagement with each of the pulleys and extending therebetween, the bow string having a nock point positioned between the pulleys which are supported by the limb members, motor means attached to the stock, means joining the motor means to the lever members, the motor means having an operative condition and an inoperative condition, the motor means being normally in its inoperative condition, the nock point of the bow string being movable to the latch member for retaining the bow string in a full drawn position, movement of the nock point of the bow string to the latch member causing rotative movement of the pulleys and causing pivotal movement of the limb members and lever members and causing the motor means to change from its inoperative condition to its operative condition, the nock point of the bow string being adapted to receive an arrow positioned adjacent the latch for launching thereof by the motor means with release of the bow string from the latch.

2. The archery bow of claim 1 in which the stock is elongate and the limb members are elongate, the length of each of the limb members being less than one-half the length of the stock.

3. The archery bow of claim 1 in which the motor means includes an axially movable piston and which includes a pair of piston rods, there being one piston rod pivotally attached to each lever member and to the piston of the motor means.

4. The archery bow of claim 1 in which the motor means comprises a housing provided with an axially movable piston therein, the housing having a given mass of gas therein, the volume and pressure of which changes with axial movement of the piston, the piston being positioned to provide greatest volume and lowest pressure of the gas with the motor means in its inoperative condition, and the piston being positioned to provide lesser volume and greater pressure of the gas with the motor means in its operative condition.

5. An archery bow for launching an arrow, comprising:

an elongate stock having a forward part and a rearward part, the forward part of the stock having a pair of opposed side portions, a pair of shafts, there being one shaft rotatively mounted at each of the opposed side portions of the stock, each shaft being rotatable about an axis normal to the axis of the elongate stock, a pair of limbs, there being a limb secured to each of the shafts for rotative movement therewith, a pair of levers, there being one lever secured to each of the shafts for rotative movement therewith, a pair of first pulleys, there being a first pulley rotatably supported by each limb adjacent the end thereof, a pair of second pulleys, there being a second pulley rotatably attached to the stock at each of the opposed side portions thereof, a bow string in engagement with each of said pulleys and attached to each of the limbs, the bow string having a nock point portion normally positioned between the pair of first pulleys, an air housing attached to the stock, a piston within the air housing and movable to change the volume and pressure of the air within the air housing, a pair of piston rods, there being a piston rod pivotally attached to each of the levers and pivotally attached to the piston, retainer means for releasably retaining the nock point portion of the bow string with an arrow in engagement therewith, the nock point portion of the bow string being movable from a position between the pair of first pulleys to the retainer means, such movement of said nock point portion of the bow string to the retainer means causing rotative movement of all of said pulleys and causing pivotal movement of the limbs and the levers, pivotal movement of the levers causing movement of the piston rods to move the piston within the air housing to reduce the volume of the air within the air housing and to increase the pressure of the air within the air housing, release of the nock point portion of the bow string from the retainer means permitting the air within the air housing to move the piston and the piston rods and the levers and the limbs and the bow string at a high rate for launching an arrow which is in engagement with the nock point portion of the bow string.

6. An archery bow of the type having a stock provided with opposed side portions and having a latch member and a trigger member, the stock being provided with a portion adapted to support an arrow for launching thereof, the combination comprising:

a pair of limb members, there being one limb member pivotally supported at each of the side portions of the stock, a pair of lever members, there being one lever member secured to each limb member for pivotal movement therewith, a plurality of pulleys, there being a pulley rotatively supported by each limb member adjacent the end thereof, there being a pulley attached to the stock at each of the opposed side portions thereof, a bow string in engagement with each of said pulleys and extending therebetween, said bow string being free of fixed attachment to any of said plurality of pulleys, said bow string further having a nock point positioned between those pulleys of said plurality of pulleys which are supported by the limb members, motor means attached to the stock, means joining the motor means to the lever members, the motor means having an operative condition and an inoperative condition, the motor means being normally in its inoperative condition, the nock point of the bow string being movable to the latch member for retaining the bow string in a full drawn position, movement of the nock point of the bow string to the latch member causing rotative movement of each of said pulleys and causing pivotal movement of the limb members and lever members and causing the motor means to change from its inoperative condition to its operative condition, the nock point of the bow string being adapted to receive an arrow positioned adjacent the latch member for launching thereof by the motor means with release of the bow string from the latch member.

* * * * *